US006708731B1

(12) United States Patent
Lamprillo

(10) Patent No.: US 6,708,731 B1
(45) Date of Patent: Mar. 23, 2004

(54) METHOD FOR MONITORING WEFT YARN RUN/STOP CONDITIONS

(75) Inventor: Stefano Lamprillo, Biella (IT)

(73) Assignee: Iropa AG, Baar (CH)

( * ) Notice: Subject to any disclaimer, the term of this patent is extended or adjusted under 35 U.S.C. 154(b) by 0 days.

(21) Appl. No.: 09/914,822

(22) PCT Filed: Mar. 1, 2000

(86) PCT No.: PCT/EP00/01769

§ 371 (c)(1),
(2), (4) Date: Jun. 13, 2002

(87) PCT Pub. No.: WO00/52243

PCT Pub. Date: Sep. 8, 2000

(30) Foreign Application Priority Data

Mar. 3, 1999 (SE) ..... 9900791

(51) Int. Cl.[7] ..... D03D 51/31
(52) U.S. Cl. ..... 139/370.2; 250/561; 340/677
(58) Field of Search ..... 139/336 R, 370.1, 139/370.2; 750/559, 561; 340/657, 677

(56) References Cited

U.S. PATENT DOCUMENTS 4,362,190 A * 12/1982 Arakawa ..... 139/370.2
4,476,901 A * 10/1984 Sainen ..... 139/370.2
4,546,263 A 10/1985 Gotoh et al.
5,031,669 A 7/1991 Wahhoud et al.
5,205,327 A * 4/1993 De Jager ..... 139/370.1
5,424,557 A * 6/1995 Rydborn ..... 250/559.01
5,477,892 A 12/1995 Corain et al.
6,112,776 A * 9/2000 Berktold ..... 139/453

FOREIGN PATENT DOCUMENTS

| | | |
|---|---|---|
| EP | 0 097 939 | 1/1984 |
| EP | 0 374 398 | 6/1990 |
| GB | 2 278 129 | 11/1994 |

* cited by examiner

*Primary Examiner*—John J. Calvert
*Assistant Examiner*—Robert H. Muromoto, Jr.
(74) *Attorney, Agent, or Firm*—Flynn, Thiel, Boutell & Tanis, P.C.

(57) ABSTRACT

A method of monitoring the weft yarn run/stop conditions during each insertion cycle in a shuttle-less weaving machine like a rapier or projectile weaving machine by means of an electronic weft yarn feeler generating run output signals representing said weft yarn run condition, said weft yarn feeler including means to adjust the working sensitivity level, comprises that the present working sensitivity level effectively used for confirming run output signals continuously and automatically is adjusted during operation of the weaving machine to oscillate about an optimum and safe working sensitivity level by observing within a predetermined restricted observation interval of each insertion cycle the signal stability at an observation sensitivity level lower than the present working sensitivity level and by lowering or raising both said present working and observation sensitivity levels in dependence from output signal stability.

13 Claims, 1 Drawing Sheet

METHOD FOR MONITORING WEFT YARN RUN/STOP CONDITIONS

FIELD OF THE INVENTION

The invention relates to a method for monitoring yarn run/stop conditions.

BACKGROUND

According to a method as known from DE-A4 417 222 (U.S. Pat. No. 5,477,892) the working sensitivity level of each of a group of weft yarn feelers is adjusted by inputting the yarn quality into a selector device having pre-set sensitivity level adjustments associated to different yarn qualities. Any set working sensitivity level is used unchanged during operation of the weaving machine. Although yarn quality is decisive for the working sensitivity level adjustment a predetermined and unchangeable adjustment of the sensitivity level has to be a compromise and does not consider further parameters also of influence for the needed working sensitivity level. For example, for a given yarn quality (yarn number) the response behaviour of an electronic weft yarn feeler varies depending from the surface quality, material flexibility and roughness of the yarn, the linear specific mass of the yarn, yarn tension and yarn speed, and moreover varies due to other parameter variations arising during weaving from the weaving behaviour or special design of the weaving machine. Such parameters are e.g. yarn tension variations, braking variations, yarn oiling, temperature, humidity, etc. A predetermined working sensitivity level strictly associated to the yarn quality precautionary has to consider all said parameters with their worst possible influence and thus is far too high. An unnecessarily high working sensitivity level, however, leads to missing stop signals because the best sensitivity level adjustment is the lowest sensitivity level that can avoid false stop signals.

Furthermore, it is known from practice on some rapier weaving machines to provide a possibility on the main control panel to select and vary different working sensitivity levels or amplification factors for the piezo-electric weft yarn feelers. Each working sensitivity level can be adjusted by the operator. However, this needs advanced skill and attention by the operator but only can lead to a working sensitivity level adjustment which for safety reasons has to be higher than actually needed.

It is a task of the invention to provide a method of the kind as disclosed allowing to reliably operate the weaving machine with an optimum working sensitivity level for each weft yarn feeler without the necessity to carry out remote adjustments.

Each respective weft yarn feeler is automatically and continuously adjusted to an optimum working sensitivity level for the respective weft yarn. Due to the automatic adjustments of the working sensitivity level not only the yarn quality but all other effectively occurring and varying parameters are considered continuously. According to the method the effectively used working sensitivity level is oscillating about an optimum adjustment level in the most decisive moments of an insertion cycle. This means that the sensitive level is permanently adjusted to the summary of all influencing parameters such that it fits to the instantaneous conditions and will follow any developments for better or worse. This eliminates false stop signals and avoids stops of the weaving machine only caused by a too low sensitivity level.

According to the invention the periodic procedures of the weft insertion is taken care of by carrying out adjustments on the basis of sampling the detected run output signals synchronised with said periods. It can be convenient to monitor the run output signal and to control the amplifier's gain individually for the feeler by multiplexing the signals and by assigning a time slot for each channel. Alternatively, it is even safer to observe the run output signal of the weft yarn feeler in two different time slots and by using two different sensitivity levels, namely the higher working sensitivity level used to confirm the run/stop conditions and the lower observation sensitivity level to observe if said lowered sensitivity level could lead to a stop.

According to the invention the lower observation sensitivity level is used to investigate safely if the lowered sensitivity level would not generate a false stop. If it turns out at the lower observation sensitivity level that the observed run output signal is stable this is taken as the confirmation that both sensitivity levels now can be lowered without the danger of a false stop. This is continued until the output run signal starts to become unstable at the observation sensitivity level. This then is taken as a proof sign to not further lower both sensitivity levels, but to now raise both sensitivity levels for a predetermined amount in order to stay on the safe side. Since the adjustment method is carried out continuously the effectively used working sensitivity level will oscillate around an optimum sensitivity level for the weft yarn in question and with consideration of all further influencing parameters.

Advantageously the difference between the present working and the observation sensitivity level is maintained essentially constant and just big enough to avoid undesirable machine stops.

In order to avoid extreme sensitivity level adjustment behaviour, it is advantageous to lower both sensitivity levels only after a predetermined number of consecutive insertion cycles have occurred with the run output signal at the lower observation sensitivity level maintaining stable. Only after having registered said number of consecutive insertions cycles with stable output signal behaviour both sensitivity levels commonly are lowered by a certain amount.

Advantageously both sensitivity levels are raised, also by a predetermined amount only, in case that an observation confirms an instability of the run output signal. In combination this means that lowering both sensitivity levels only is only carried out after first confirming a predetermined number of correct insertion cycles, but both sensitivity levels immediately are raised in case of occurring signal instability. As long as the run output signal at the lower observation sensitivity level remains stable both sensitivity levels are lowered step by step in order to approach an optimum working sensitivity level as soon as possible.

Both sensitivity levels may either be raised and lowered always by one step or for a predetermined time interval.

In order to maintain the effectively used working sensitivity level close to an optimum sensitivity level it is expedient to have only one step difference between the working sensitivity level and the observation sensitivity level.

In order to achieve a high resolution of the adjustment it is preferred to use about 32 steps. Each step represents an individual signal amplification factor meaning that the adjustments carried out actually is a step-wise variation of the amplification factor.

According to a preferred embodiment of the method the run output signal within the restricted observation interval of each insertion cycle is sampled in different adjacent time slots for both sensitivity levels. Said method can easily be carried out with a microprocessor or microcontroller using the same circuitry for the observation as is used for gaining the working signal output. This means that the microprocessor of the weft yarn feeler is consecutively switching back and forth between both sensitivity levels without the danger of losing any significant run output signal variations.

Preferably the observation interval is restricted to an angle range of a full revolution of the rapier weaving machine beginning at about 220° to 280° and ending at about 280° to 310°. This means that the observation is carried out within essentially the angle range used to evaluate the correct run/stop conditions as well. Within said angle range in a rapier machine relatively smooth speed and tension variations are occurring in the yarn, which is advantageous for the reliability of the method.

In case that a weft yarn feeler device consisting of several weft yarn feelers is used, either each individual weft yarn feeler is controlled individually or the result of the observation of one of the weft yarn feelers is used to also adjust the working sensitivity level of other weft feelers processing an equal yarn or the same yarn quality.

BRIEF DESCRIPTION OF THE DRAWINGS

The invention will be described with the help of the drawing.

DETAILED DESCRIPTION

Figure 1:
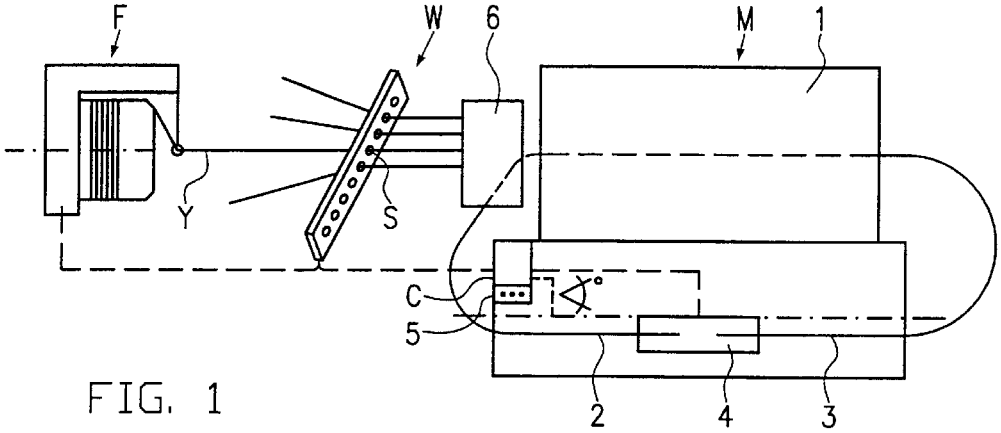
FIG. 1 is a schematic view of a yarn processing system containing a weft yarn feeler device.

A yarn processing system in FIG. 1 includes a weaving machine M, particularly a rapier weaving machine, further at least one yarn feeding device F, and a weft yarn feeler device W e.g. consisting of several parallel weft feelers S. Said rapier weaving machine M includes a shed 1, a bringer rapier 2 and a receiver rapier 3, both driven by drive mechanism 4, a main control and/or monitoring unit C and a weaving machine control panel 5. Close to the entrance of shed 1 a yarn selecting device 6 is provided which is controlled by e.g. control unit C. Weft yarn feeler device W is connected e.g. to control unit C and/or to the feeder's control or a so-called stop-motion relay.

Figure 2:
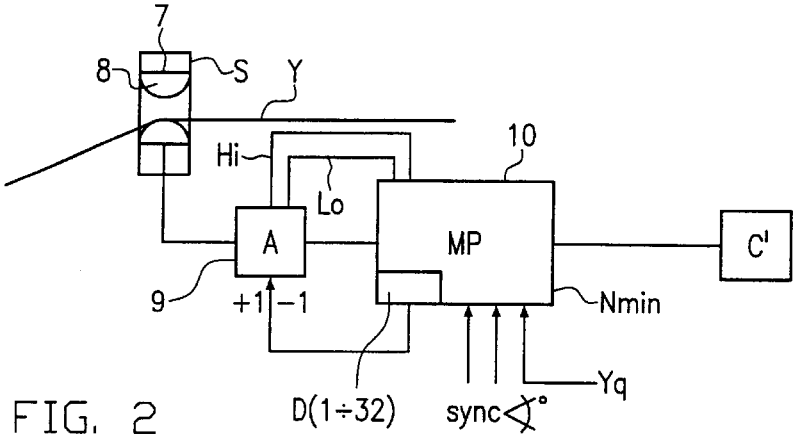
FIG. 2 is a block diagram, schematically indicating the line-up of an essential part of a yarn feeler.

Each weft yarn feeler S in FIG. 2 can be in the form of a yarn guiding element 7 containing e.g. a piezo-electric sensor 8. The weft yarn Y is penetrating said weft yarn feeler S and is exciting the piezo-electric sensor 8 by friction forces or vibrations to which sensor 8 responds by generating an electric run signal. Said run signal is amplified by an amplifying component A, 9, outputting a run output signal as long as the yarn keeps on running through element 7. As soon as the weft yarn Y becomes slack or breaks no run signal will be output. A microprocessor MP for evaluating the run output signal is connected to a signal evaluation or responding component C'. e.g. a stop switch. Microprocessor MP is provided with e.g. 32 steps representing different sensitivity levels in a table or a storing part D, which. e.g. via a driver or shift register is connected to amplifier component A, 9 in order to set or vary the amplification factor or sensitivity level by consecutive positive or negative steps as +1 or −1. Furthermore, microprocessor MP or any advanced circuitry 10 is connected to amplifier component A, 9 in order to selectively operate amplifier component A, 9 with one of two different sensitivity levels Hi, Lo, i.e. a higher working sensitivity level Hi and a lower observation sensitivity level Lo out of the e.g. 32 available levels. Furthermore, microprocessor MP can be equipped with a clock, a counter and a setting section for setting several different parameters like a sync-setting depending on the weaving machine operation, an angle setting for cutting out a restricted angle range of a full 360° revolution only, e.g. of the main shaft of the weaving machine, a yarn quality setting YQ and a counter setting for a predetermined number of consecutive insertion cycles Nmin.

Figure 3:
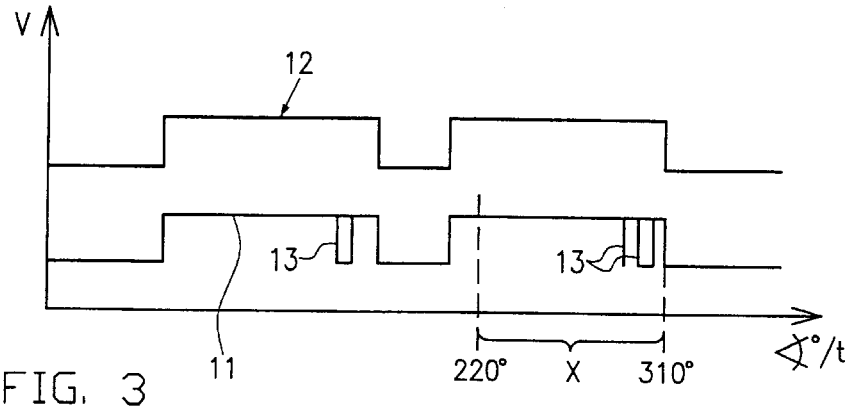
FIG. 3 is a diagram with signal chains.

FIG. 3 shows in diagrammatic form in upper curve 12 how the run output signal is behaving over a 360° insertion cycle of the weaving machine. A higher level in curve 12 indicates the correct yarn run, the lower level of curve 12 represents a yarn stop or extreme deceleration. Signal chain 12 is used to trigger e.g. switch component C' in FIG. 2 in order to confirm a correct weft yarn run and stop condition during an insertion cycle. Curve 12 is derived at said higher present working sensitivity level Hi. This can be done by additionally considering a sync-signal indicating when said weft yarn Y is expected to run and when not.

Lower curve 11 indicates how the same run output signal is evaluated at a lower observation sensitivity level Lo in order to observe and find out whether the run output signal is stable within a restricted observation range X. Said observation range X may be restricted to an angle range between 220° and 310° of a full 360° weaving machine cycle. In the first part of the same insertion cycle, e.g. between 0° and 220° neither of both signal chains 11, 12 is considered or evaluated for the actuation of switch component C' or to observe whether the run output signal is stable.

Curve 11 is shown in FIG. 3 when the lower observation sensitivity level Lo has been lowered too much, i.e. is too low in order to gain a stable run output signal. This is indicated by signal chain variations or instabilities 13 indicating that within observation range X the signal quality is not satisfactory.

The effectively used working sensitivity level Hi according to one of the available steps is adjusted to an optimum but nevertheless safe sensitivity level as follows:

The weaving machine M starts operating and is consuming weft yarn Y as monitored by weft yarn feeler S. The parameters as indicated in FIG. 2 are set in microprocessor component MP, 10. Weft yarn feeler S first is adjusted to operate with a high working sensitivity level Hi. Provided that for Nmin consecutive insertion cycles run output signal 11 does not show instabilities 13 within range X both sensitivity levels are lowered by one step. It then is observed over the next consecutive number Nmin whether instabilities 13 occur. If not, both sensitivities again are lowered by one step. This is continued until instabilities 13 occur during observation in range X. If yes, both sensitivity levels immediately are raised by one step. Then again it is observed whether for Nmin consecutive insertion cycles instabilities 13 will occur. If no instabilities occur again both sensitivity levels are lowered by one step and so on. Said method is carried on during the operation of the weaving machine M such that the effectively used working sensitivity level Hi always will oscillate around an optimum sensitivity level.

The end point or angle of the observation range X has to be the same angular position at which the weaving machine control unit C stops to consider the output of weft yarn feelers to generate a weaving machine stop signal. Said end position furthermore is related to the position where the receiver rapier 3 releases the weft yarn Y. The weft feeler S with its control circuit is using two different sensitivity levels, namely the higher working sensitivity level Hi and the lower observation sensitivity level Lo, both preferably differing by one step only. However, it is possible to use other bigger and smaller differences as well. Said observation can be carried out for one weft feeler S only and can be used to adjust the sensitivity levels of other adjacent weft feelers as well, provided that they are processing the same yarn quality. However, alternatively each weft feeler provided can be adjusted individually. If the weft yarn is broken, the output run signal (curves 11 and 12) will drop within the observation interval or range X and a machine stop will be commanded by the machine control unit C or the stop motion relay. The continuous adjustment of the sensitivity level effectively used is necessary to compensate for parametric fluctuations during the weaving operation. The run output signal is checked in different and adjacent time slots at two different sensitivity levels. A run output signal is still found to be stable at the observation sensitivity level if all samples within the defined observation interval confirm that the yarn is running. The stability observation is done by the same circuitry as used for the normal monitoring of the weft yarn run. Said circuitry however is used with two different sensitivity settings in different times. It is useful to use a high number of different sensitivity levels, e.g. 32, for a better resolution. The microcontroller or microprocessor MP as used should be powerful enough for carrying out the method throughout the entire operation of the weaving machine. Parametric variations causing signal fluctuation during weaving might occur due to yarn tension variations, braking variations, varying yarn oiling conditions, varying temperatures and varying humidity. The run output signal is observed between e.g. 220° and 310° of a 360° weaving machine cycle due to the fact that the most critical phase of the weft yarn monitoring is the end phase of the weft yarn control, usually set near the opening position of the receiver rapier gripper which causes the yarn speed to decrease to zero. Incidentally, in this range a relatively moderate speed profile is present. However, it is not necessary to concentrate on this small range, because the method uses more cycles or consecutive numbers of correct insertions to decide whether a sensitivity level downshift is justified, instead of basing the decision only on a single signal evaluation. The working sensitivity level is lowered step by step together with the observation sensitivity and must not be held at the start level until a convenient lower sensitivity level has been adjusted.

What is claimed is:

1. Method of monitoring weft yarn run/stop conditions during the insertion cycles of a shuttle-less weaving machine like a rapier or projectile weaving machine (M) by means of a weft yarn actuated electronic weft yarn feeler (W, S) operating with a working sensitivity level (Hi) for generating run output signals, said weft yarn feeler (W, S) comprising electronic means to adjust said working sensitivity level, characterised in that the present working sensitivity level (Hi) as effectively used for confirming run/stop weft yarn conditions continuously and automatically is adjusted during operation of said weaving machine to oscillate about an optimum and safe working sensitivity level by observing within a predetermined restricted observation interval (X) of each insertion cycle the signal stability of the run output signal under consideration of an observation sensitivity level (Lo) lower than the respective present working sensitivity level (Hi), and by lowering or raising the present working and observation sensitivity levels in dependence from the observed signal stability.

2. Method as in claim 1, characterised in that the difference between said present working sensitivity level (Hi) and said observation sensitivity level (Lo) is maintained essentially constant.

3. Method as in claim 1, characterised in that prior to lowering both said present working and said observation sensitivity levels said signal stability for the observation sensitivity level (Lo) first is observed during a predetermined number (Nmin) of consecutive insertion cycles.

4. Method as in claim 1, characterised in that said present working and said observation sensitivity levels are raised commonly as soon as a signal instability (13) or missing output signal stability is observed.

5. Method as in claim 1, characterised in that both said present working and said observation sensitivity levels are raised or lowered each in one step, preferably by the same amount.

6. Method as in claim 1, characterised in that both said present working and said observation sensitivity levels are raised or lowered each for a predetermined time interval, preferably of the same time amount.

7. Method as in claim 2, characterized in that said difference between said present working sensitivity level and said observation sensitivity level corresponds to at least one step or one time interval.

8. Method as in claim 5, characterised in that said present working and said observation sensitivity levels can be raised or lowered totally for a plurality of steps, e.g. for 32 steps.

9. Method as in claim 8, characterised in that each step is representing an individual signal amplification factor for the generation of an output signal.

10. Method as in claim 1, characterized in that at least within said restricted observation interval (X) the run output signal is sampled in different, adjacent time slots for said present working and said observation sensitivity levels.

11. Method as in claim 1, characterised in that the observation of the run output signal with respect to stability and at the observation sensitivity level (Lo) is carried out by a circuitry otherwise used in other time slots to confirm run output signals at the working sensitivity level (hi).

12. Method as in claim 2, characterised in that the observation interval (X) is restricted to an angle range of a 360°-rapier-weaving machine cycle beginning at about 220° to 280° and ending at about 280° to 310°, preferably said angle range end being determined by the angle where a superimposed weaving machine control unit (C) stops to consider the operation of the weft feeler (W, S) and which angle is related to the angle position where the receiver rapier (3) releases the weft yarn (Y).

13. Method as in claim 1, characterised in that in case of several parallel weft yarn feelers (S) the working sensitivity level is commonly adjusted for more than one weft yarn feeler processing the same weft yarn quality on the basis of the observation of the signal stability at the observation sensitivity level for one weft yarn feeler (S) only.

* * * * *